US007506469B2

(12) United States Patent
Poulin et al.

(10) Patent No.: US 7,506,469 B2
(45) Date of Patent: Mar. 24, 2009

(54) FIREARM FRAME WITH CONFIGURABLE GRIP

(75) Inventors: Michael J. Poulin, Granby, MA (US); Sean O'Clair, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 295 days.

(21) Appl. No.: 11/315,790

(22) Filed: Dec. 22, 2005

(65) Prior Publication Data

US 2006/0150467 A1 Jul. 13, 2006

Related U.S. Application Data

(60) Provisional application No. 60/638,752, filed on Dec. 22, 2004, provisional application No. 60/639,187, filed on Dec. 22, 2004, provisional application No. 60/638,594, filed on Dec. 22, 2004, provisional application No. 60/638,753, filed on Dec. 22, 2004, provisional application No. 60/638,593, filed on Dec. 22, 2004, provisional application No. 60/638,746, filed on Dec. 22, 2004, provisional application No. 60/638,592, filed on Dec. 22, 2004, provisional application No. 60/638,751, filed on Dec. 22, 2004.

(51) Int. Cl.
*F41C 23/10* (2006.01)

(52) U.S. Cl. ..... 42/71.02

(58) Field of Classification Search ..... 42/71.02, 42/72, 73, 74; D22/104
See application file for complete search history.

(56) References Cited

U.S. PATENT DOCUMENTS 2,034,632 A * 3/1936 Rice ..... 42/71.02
2,308,627 A * 1/1943 Rickenbacher ..... 42/71.02
2,320,450 A * 6/1943 Valenzuela ..... 42/106
2,509,553 A * 5/1950 Wylie ..... 42/71.02
2,903,811 A * 9/1959 Freed ..... 42/74
3,128,571 A * 4/1964 Herrett ..... 42/71.02
3,226,870 A * 1/1966 Labbie et al. ..... 42/71.02
3,327,421 A * 6/1967 Finkelstein ..... 42/71.02
3,397,475 A * 8/1968 Mikus ..... 42/71.02

(Continued)

OTHER PUBLICATIONS

MAGPUL 2007 Catalog, MIAD—Mission Adaptable AR15/M16 Grip Basic Kit. The status of this web page, and the products shown therein, as prior art is uncertain.

*Primary Examiner*—Bret Hayes
(74) *Attorney, Agent, or Firm*—McCormick, Paulding & Huber LLP

(57) ABSTRACT

A configurable firearm grip is provided in which a removable portion thereof can be selected by the user based on the user's preference. For example, backstraps of various forms, thicknesses, and textures can be fitted to a handgun depending upon if the handgun is to be used for target shooting, competitive target shooting, hunting, personal protection, or any other shooting activity, or to accommodate varying hand sizes. The backstrap can be removed and installed without the use of tools. Cooperative portions on the inner surfaces of the backstrap and the rearward portion of the grip facilitate the registration of the backstrap with a fixed portion in preparation for the insertion of a locking element. The backstrap is able to be secured on the fixed grip portion of the handgun with one hand while the locking element is inserted through the backstrap and the fixed grip portion with the other hand.

9 Claims, 4 Drawing Sheets

U.S. PATENT DOCUMENTS

| | | | | | |
|---|---|---|---|---|---|
| 3,672,084 | A | * | 6/1972 | Pachmayr | 42/71.02 |
| 3,683,535 | A | * | 8/1972 | Lewis | 42/71.02 |
| 3,815,270 | A | * | 6/1974 | Pachmayr | 42/71.02 |
| 4,011,678 | A | | 3/1977 | Brodbeck et al. | |
| 4,031,648 | A | | 6/1977 | Thomas | |
| 4,043,066 | A | * | 8/1977 | Pachmayr et al. | 42/71.02 |
| 4,199,887 | A | * | 4/1980 | Hogue | 42/71.02 |
| 4,276,709 | A | * | 7/1981 | Bross | 42/71.02 |
| 4,315,379 | A | * | 2/1982 | Lang | 42/71.02 |
| 4,333,256 | A | * | 6/1982 | Hogue | 42/71.02 |
| 4,342,170 | A | * | 8/1982 | Hogue et al. | 42/71.02 |
| 4,359,833 | A | * | 11/1982 | Pachmayr et al. | 42/71.02 |
| 4,409,882 | A | * | 10/1983 | Blackshaw et al. | 89/163 |
| 4,522,105 | A | | 6/1985 | Atchisson | |
| 4,539,889 | A | | 9/1985 | Glock | |
| 4,570,370 | A | * | 2/1986 | Smith et al. | 42/90 |
| 4,586,282 | A | * | 5/1986 | Sniezak | 42/71.02 |
| 4,625,445 | A | * | 12/1986 | Ruger | 42/71.02 |
| 4,638,582 | A | * | 1/1987 | Farrar | 42/71.02 |
| 4,658,528 | A | * | 4/1987 | Ruger | 42/71.02 |
| 4,771,562 | A | * | 9/1988 | Ruger | 42/71.02 |
| 4,825,744 | A | | 5/1989 | Glock | |
| 4,833,812 | A | * | 5/1989 | Farrar | 42/71.02 |
| 4,878,304 | A | * | 11/1989 | Cupp | 42/71.02 |
| 4,893,546 | A | | 1/1990 | Glock | |
| 4,936,036 | A | * | 6/1990 | Sniezak et al. | 42/71.02 |
| 4,967,503 | A | * | 11/1990 | Farrar | 42/71.02 |
| 4,967,724 | A | | 11/1990 | Senfter | |
| 4,999,941 | A | * | 3/1991 | Farrar | 42/71.02 |
| 5,012,604 | A | | 5/1991 | Rogers | |
| 5,018,292 | A | | 5/1991 | West | |
| 5,024,139 | A | | 6/1991 | Knight, Jr. et al. | |
| 5,036,612 | A | | 8/1991 | Jennings | |
| 5,048,214 | A | * | 9/1991 | Cohen | 42/71.02 |
| 5,048,215 | A | | 9/1991 | Davis | |
| 5,050,329 | A | * | 9/1991 | Hogue et al. | 42/71.02 |
| 5,050,480 | A | | 9/1991 | Knight, Jr. et al. | |
| 5,050,481 | A | | 9/1991 | Knight, Jr. et al. | |
| 5,081,780 | A | | 1/1992 | Lishness et al. | |
| 5,086,578 | A | | 2/1992 | Lishness et al. | |
| 5,086,579 | A | | 2/1992 | Flatley et al. | |
| 5,088,222 | A | | 2/1992 | Larson | |
| 5,090,147 | A | | 2/1992 | Pastor | |
| 5,105,570 | A | | 4/1992 | Lishness et al. | |
| 5,115,588 | A | | 5/1992 | Bronsart et al. | |
| 5,119,634 | A | | 6/1992 | Berry et al. | |
| 5,149,898 | A | | 9/1992 | Chesnut et al. | |
| 5,157,209 | A | | 10/1992 | Dunn | |
| 5,159,136 | A | | 10/1992 | Marsh | |
| 5,160,796 | A | | 11/1992 | Tuma et al. | |
| 5,164,534 | A | | 11/1992 | Royster | |
| 5,166,458 | A | | 11/1992 | Yoo | |
| 5,166,459 | A | * | 11/1992 | Stahle | 42/71.02 |
| 5,183,952 | A | * | 2/1993 | Morales | 42/71.02 |
| 5,187,312 | A | | 2/1993 | Osborne | |
| 5,195,226 | A | | 3/1993 | Bornancini | |
| 5,216,191 | A | | 6/1993 | Fox | |
| 5,216,195 | A | | 6/1993 | Tuma | |
| 5,225,612 | A | | 7/1993 | Bernkrant | |
| 5,231,237 | A | * | 7/1993 | Cupp | 42/71.02 |
| 5,235,770 | A | | 8/1993 | Simon et al. | |
| 5,241,769 | A | | 9/1993 | Von Muller | |
| 5,247,757 | A | | 9/1993 | Deeb | |
| 5,251,394 | A | | 10/1993 | Bornancini | |
| 5,267,407 | A | | 12/1993 | Bornancini | |
| 5,272,957 | A | | 12/1993 | Chesnut et al. | |
| 5,299,374 | A | | 4/1994 | Mathys | |
| 5,303,494 | A | | 4/1994 | Tuma et al. | |
| 5,327,810 | A | | 7/1994 | Sandusky et al. | |
| 5,349,939 | A | | 9/1994 | Perrone | |
| 5,355,768 | A | | 10/1994 | Felk | |
| 5,373,775 | A | | 12/1994 | Findlay, Sr. et al. | |
| 5,386,659 | A | | 2/1995 | Vaid et al. | |
| 5,388,362 | A | | 2/1995 | Melcher | |
| 5,400,537 | A | | 3/1995 | Meller et al. | |
| 5,406,731 | A | * | 4/1995 | Stevens | 42/71.02 |
| 5,412,894 | A | | 5/1995 | Moon | |
| 5,417,001 | A | | 5/1995 | Rousseau | |
| 5,426,881 | A | | 6/1995 | Ruger | |
| 5,438,784 | A | | 8/1995 | Lenkarski et al. | |
| 5,448,939 | A | | 9/1995 | Findlay, Sr. et al. | |
| 5,465,520 | A | * | 11/1995 | Cupp | 42/71.02 |
| 5,483,766 | A | * | 1/1996 | Hochstrate et al. | 42/75.03 |
| 5,487,233 | A | | 1/1996 | Jewell | |
| 5,493,806 | A | | 2/1996 | Langevin et al. | |
| 5,502,914 | A | | 4/1996 | Moon | |
| 5,517,896 | A | | 5/1996 | Perrine | |
| 5,517,987 | A | | 5/1996 | Tsuchiya | |
| 5,548,914 | A | | 8/1996 | Anderson | |
| 5,560,136 | A | * | 10/1996 | Cupp | 42/71.02 |
| 5,570,527 | A | | 11/1996 | Felicci | |
| 5,581,927 | A | | 12/1996 | Meller | |
| 5,604,326 | A | | 2/1997 | Lescure | |
| 5,606,825 | A | | 3/1997 | Olsen | |
| 5,615,507 | A | | 4/1997 | French | |
| 5,621,997 | A | * | 4/1997 | Pearce | 42/71.02 |
| 5,623,114 | A | | 4/1997 | Soper | |
| 5,625,971 | A | | 5/1997 | Tuma et al. | |
| 5,634,456 | A | | 6/1997 | Perrone | |
| 5,635,664 | A | | 6/1997 | Pons et al. | |
| 5,640,794 | A | | 6/1997 | Gardner et al. | |
| 5,655,326 | A | | 8/1997 | Levavi et al. | |
| 5,669,169 | A | | 9/1997 | Schmitter et al. | |
| 5,680,722 | A | | 10/1997 | French et al. | |
| 5,697,178 | A | | 12/1997 | Haskell | |
| 5,701,698 | A | | 12/1997 | Wesp et al. | |
| 5,709,046 | A | | 1/1998 | Canaday | |
| 5,711,286 | A | | 1/1998 | Petrosyan et al. | |
| 5,713,150 | A | | 2/1998 | Ealovega | |
| 5,717,156 | A | | 2/1998 | Lenkarski | |
| 5,718,074 | A | | 2/1998 | Keeney | |
| 5,736,667 | A | | 4/1998 | Munostes et al. | |
| 5,760,328 | A | | 6/1998 | Robbins | |
| 5,770,814 | A | | 6/1998 | Ealovega | |
| 5,778,585 | A | | 7/1998 | Sigg | |
| 5,797,206 | A | | 8/1998 | Vitorino | |
| 5,797,207 | A | * | 8/1998 | Marable et al. | 42/71.02 |
| 5,806,225 | A | | 9/1998 | Gardner et al. | |
| 5,815,973 | A | | 10/1998 | Hochstrate | |
| 5,826,362 | A | | 10/1998 | Lyons | |
| 5,834,678 | A | | 11/1998 | Kalb | |
| 5,852,891 | A | | 12/1998 | Onishi et al. | |
| 5,857,279 | A | * | 1/1999 | de Oliveira Masina | 42/71.01 |
| 5,857,280 | A | | 1/1999 | Jewell | |
| 5,906,066 | A | | 5/1999 | Felk | |
| 5,913,261 | A | | 6/1999 | Guhring et al. | |
| 5,974,717 | A | | 11/1999 | Brooks | |
| 5,987,796 | A | | 11/1999 | Brooks | |
| 6,000,162 | A | | 12/1999 | Hochstrate | |
| 6,070,512 | A | | 6/2000 | Rohrbaugh | |
| 6,073,381 | A | * | 6/2000 | Farrar et al. | 42/71.02 |
| 6,112,446 | A | * | 9/2000 | Forster et al. | 42/71.02 |
| 6,125,735 | A | | 10/2000 | Guhring | |
| 6,131,324 | A | | 10/2000 | Jewell | |
| 6,134,852 | A | | 10/2000 | Shipman et al. | |
| 6,164,001 | A | | 12/2000 | Lee | |
| 6,205,694 | B1 | | 3/2001 | Davis, Sr. | |
| 6,240,669 | B1 | | 6/2001 | Spaniel et al. | |
| 6,253,479 | B1 | | 7/2001 | Fuchs et al. | |
| 6,256,918 | B1 | | 7/2001 | Szabo | |
| 6,256,920 | B1 | | 7/2001 | Olson | |
| 6,263,607 | B1 | | 7/2001 | Fuchs et al. | |
| 6,266,909 | B1 | | 7/2001 | Fuchs et al. | |
| 6,272,683 | B1 | | 8/2001 | Symms et al. | |

6,272,783 B1 8/2001 Dumortier et al.
6,289,619 B1 9/2001 Fuchs et al.
6,293,039 B1 9/2001 Fuchs
6,301,818 B1 * 10/2001 Hogue ..... 42/71.02
6,341,442 B1 1/2002 Szabo et al.
6,354,032 B1 3/2002 Viani
6,367,186 B1 4/2002 Gibala
6,381,892 B1 5/2002 Szabo et al.
6,382,200 B1 5/2002 Levkov
6,405,631 B1 6/2002 Milek
6,412,206 B1 7/2002 Strayer
6,415,702 B1 7/2002 Szabo et al.
6,425,199 B1 7/2002 Vaid et al.
6,448,939 B2 9/2002 Maruta
6,513,273 B2 2/2003 da Silveira
6,519,887 B1 2/2003 Allen et al.
6,526,684 B1 3/2003 Hickerson
6,536,152 B1 3/2003 Wisz
6,539,658 B1 4/2003 Hubert et al.
6,543,169 B2 4/2003 Bero
6,553,706 B1 4/2003 Gancarz et al.
6,557,288 B2 5/2003 Szabo
6,560,909 B2 5/2003 Cominolli
6,588,136 B2 7/2003 Baker et al.
6,601,331 B2 8/2003 Salvitti
6,615,527 B1 9/2003 Martin
6,640,478 B2 11/2003 Johansson
6,643,968 B2 11/2003 Glock
6,655,066 B2 12/2003 Fluhr
6,658,781 B1 * 12/2003 Bowen ..... 42/71.02
6,665,973 B1 12/2003 Peev
6,688,210 B2 2/2004 Bubits
6,705,036 B2 3/2004 Orr
6,711,824 B2 3/2004 Hruska
6,711,842 B1 3/2004 Chapman
6,718,680 B2 4/2004 Roca et al.
6,732,464 B2 5/2004 Kurvinen
6,735,897 B1 5/2004 Schmitter et al.
6,769,208 B2 8/2004 Beretta
6,789,342 B2 9/2004 Wonisch et al.
6,854,205 B2 2/2005 Wikle et al.
6,981,344 B2 1/2006 Cahill et al.

* cited by examiner

FIREARM FRAME WITH CONFIGURABLE GRIP

CROSS REFERENCE TO RELATED APPLICATIONS

This application claims the benefit of the following U.S. Provisional Applications: Ser. Nos. 60/639,187; 60/638,594; 60/638,753; 60/638,593; 60/638,746; 60/638,592; 60/638,751; and 60/638,752, all filed Dec. 22, 2004, and all hereby incorporated by reference herein in their entireties.

FIELD OF THE INVENTION

This invention relates generally to firearm grips and, more particularly, to a firearm on which the grips can be configured at the desire of the user.

BACKGROUND OF THE INVENTION

The grip, or grip portion, of a handgun functions as the user physically interfaces with the handgun. Accordingly, control of the handgun is the direct result of the hand pressure that the user exerts on the grip. Because hand sizes among different users vary greatly, the grip of a handgun can be modified to accommodate various users. Moreover, it may also be desirable for a user to configure the grip of a handgun depending on the particular shooting application. For example, a user may prefer a grip having a soft texture for use in applications in which the handgun is subjected to repeated use in a short period of time (e.g., competitive shooting matches). The same user may prefer a grip having a hard, smooth texture for carrying the handgun in instances where the grip repeatedly contacts the user's skin (e.g., while being carried in a holster under a shirt or in a trouser leg). Additionally, multiple users with varying handsizes may share a firearm, making it desirable to increase or decrease the grip size, and particularly the size of the backstrap portion.

The grips of some handguns allow sleeves or similar devices to be inserted thereover to allow the grip to be modified. However, modifications made by such a method generally add weight and thickness to the grip, thereby forcing the user to alter his manual grip, or hold, on the firearm. Modifications may also be made by removing an existing grip portion from the handgun frame to allow a different grip portion to be installed. In these instances, the removal of the grip portion often requires tools (e.g., screwdrivers, hex wrenches, punches, or the like) to remove screws or pins that maintain the grip portions on the frame. The use of tools generally complicates the process by which the grip portions are changed. Consequently, users may be less likely to modify the grips of their handguns for different purposes.

What is needed is a handgun on which a grip portion can be easily interchanged with another grip portion depending upon the particular needs of the user.

SUMMARY OF THE INVENTION

According to an embodiment of the present invention, a firearm includes a configurable grip having fixed and removable portions, each portion having at least one standoff element with a bore therein, the removable portion being secured to the fixed portion by a locking element removably disposed through the bores of each standoff element.

In an additional embodiment, one advantage of the present invention is that the handgun grip, particularly a removable portion thereof (e.g. the backstrap, also called the "grip-strap"), can be selected by the user based on the user's preference. Backstraps of various forms, thicknesses, and textures can be fitted to a handgun depending upon if the handgun is to be used for target shooting, competitive target shooting, hunting, personal protection, or any other shooting activity.

In an additional embodiment, another advantage of the present invention is that the removable grip portion, (e.g. the backstrap) can be removed and installed without the use of tools. Cooperative portions on the inner surfaces of the backstrap and the rearward portion of the grip facilitate the registration of the backstrap with the frame in preparation for the insertion of a locking element, typically a pin. Thus, a user can secure the backstrap in place on the frame of the handgun with one hand and with relative ease and insert the locking pin through the backstrap and into the frame with the other hand.

DETAILED DESCRIPTION OF THE PREFERRED EMBODIMENTS

Figure 1:
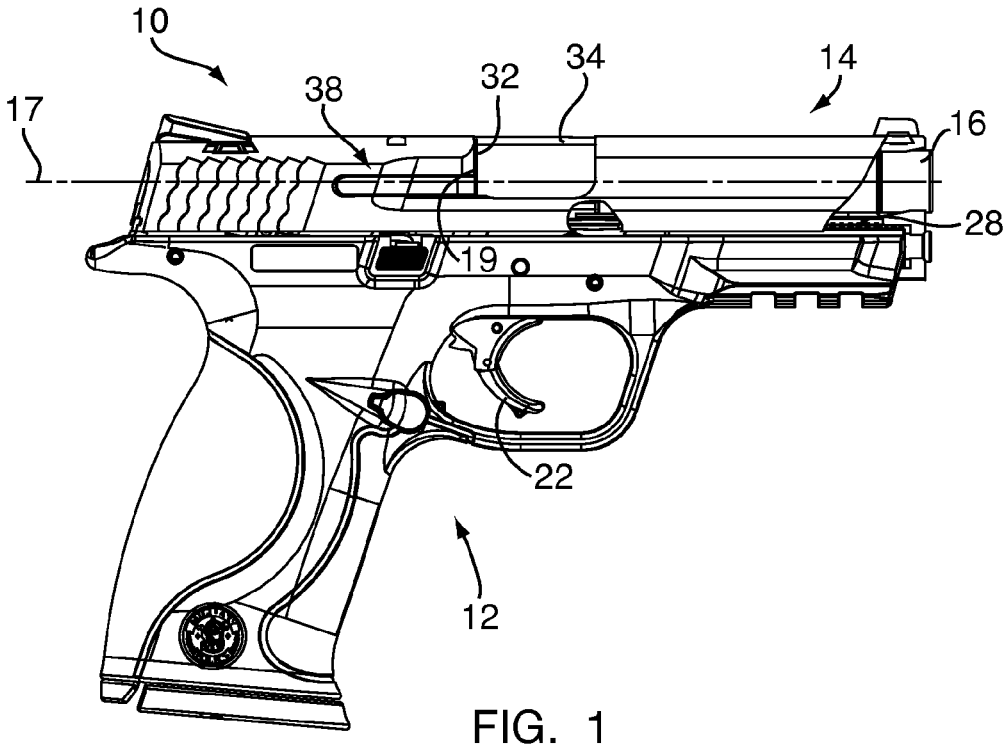
FIG. 1 is a side view of a semiautomatic pistol.
Figure 2:
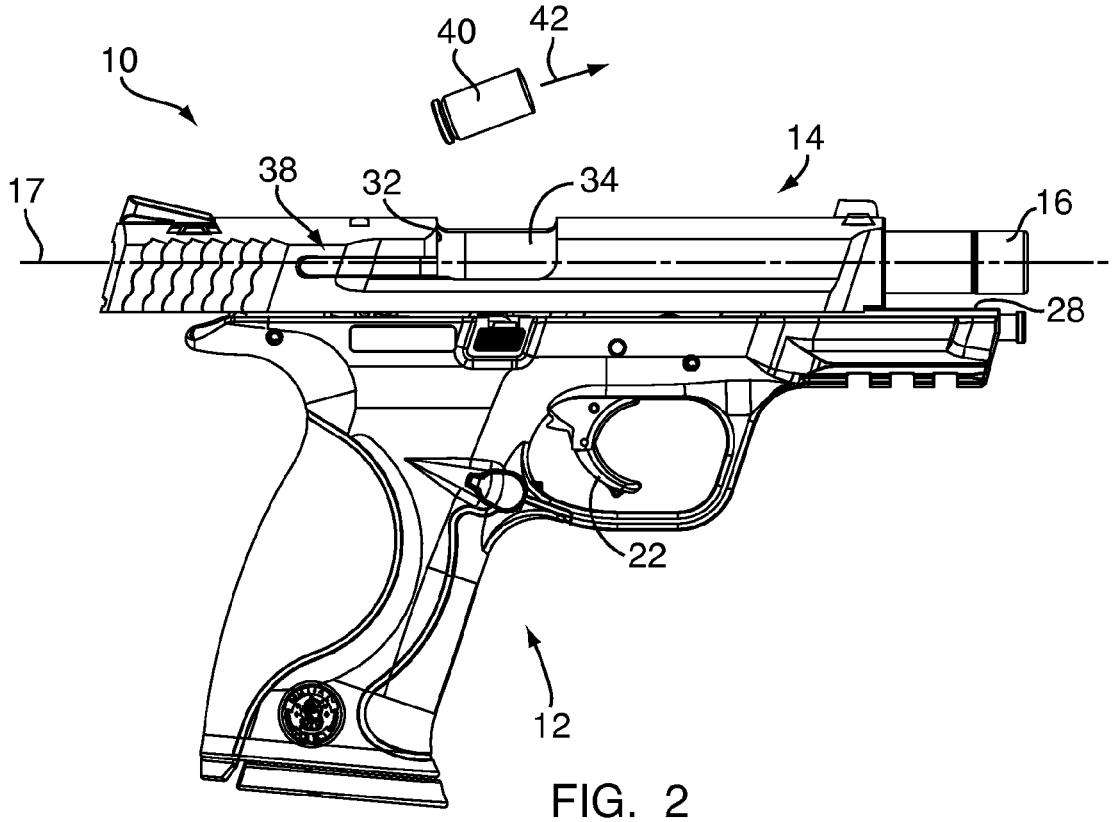
FIG. 2 is a side view of the pistol of FIG. 1 shown with the slide moved to a rearward position on the pistol frame.

Referring to FIGS. 1 and 2, a semiautomatic pistol or handgun is shown generally at 10 and is hereinafter referred to as "handgun 10." The handgun 10 comprises a frame 12, a slide 14, and a fire control mechanism that operates via actuation of a trigger 22. The frame 12 is fabricated of a high-impact polymer material, metal, or a combination of polymer and metal. The slide 14 houses a barrel 16 in the forward end thereof. The barrel 16 is cooperatively linked with the slide 14 and, together with the slide 14, defines a longitudinal firing axis 17. A rearward end 19 of the barrel 16 is adapted for receiving an ammunition cartridge.

The slide 14 is fitted to opposingly-positioned rails 28 on the frame 12 to effect the reciprocal movement of the slide 14 along the longitudinal firing axis 17. The rails 28 extend along the underside of the slide 14 in the longitudinal direction and are cooperative with the frame 12 to allow the cycling of the slide 14 between forward (battery) and rearward (retired) positions. The slide 14 further includes a breech face 32 and an extractor port 34. The breech face 32 is engagable with the rearward end 19 of the barrel 16 to form a firing chamber when the slide 14 is disposed forwardly on the frame 12. An ejection mechanism 38 provides for the ejection of a cartridge casing 40 in a direction indicated by an arrow 42 upon firing the handgun 10 or manually cycling the slide 14.

Figure 3:
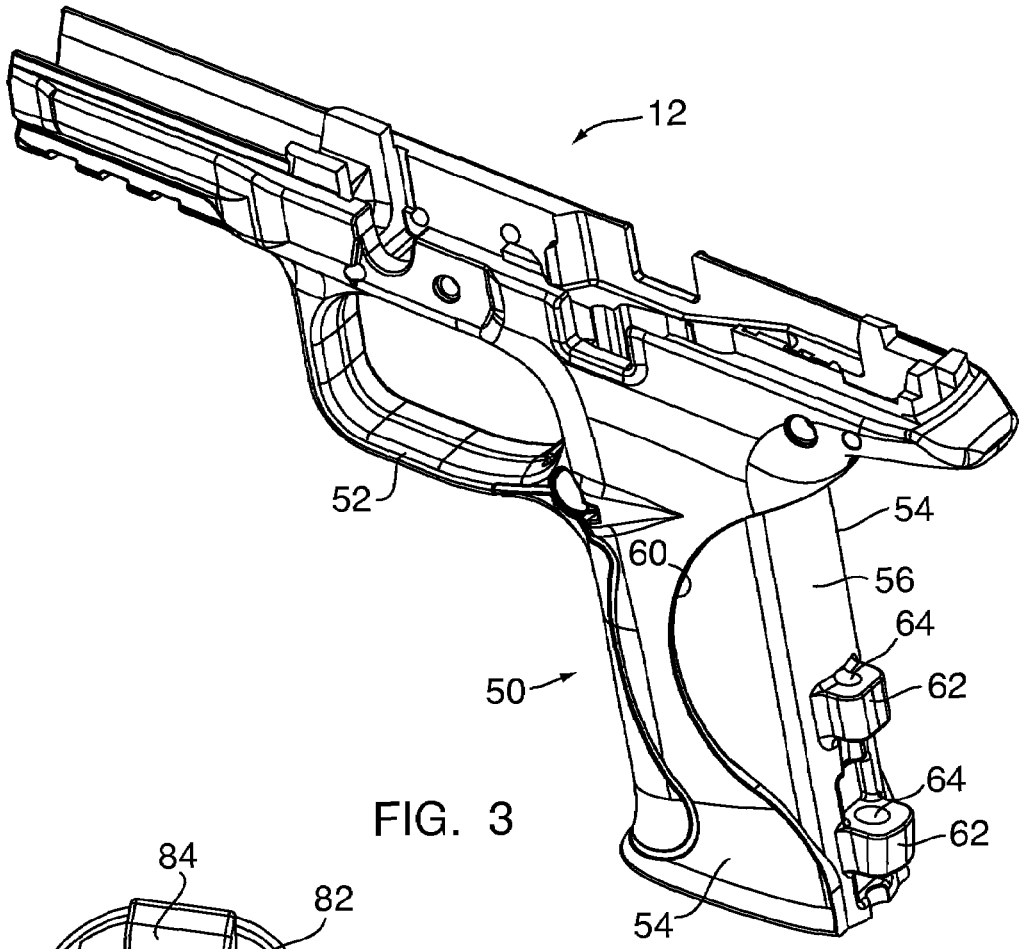
FIG. 3 is a perspective view of a frame of a semiautomatic pistol on which a removable backstrap of the present invention can be mounted.

Referring now to FIG. 3, the frame 12 comprises a fixed grip portion 50 configured to receive a removable grip portion, together forming a grip graspable by a user. A trigger guard 52 is typically positioned forward of the fixed grip portion 50. In a semiautomatic handgun, the fixed grip portion 50 typically houses a magazine insertable into the frame 12 from a downward-facing opening in the fixed grip portion 50. The fixed grip portion 50 itself is defined by outer surfaces, such as opposingly-positioned side surfaces 54 that may meet at forward-facing edges thereof either with each other or a forward-facing surface. Rearward-facing edges of the side surfaces 54 engage with a rear surface 56 at which a removable grip portion, or backstrap (shown below with reference to FIGS. 4, 5, and 7) is positioned.

The opposingly-positioned side surfaces 54 may be contoured or otherwise configured to receive corresponding contoured structure on the backstrap. In particular, the surfaces 54 may each include a relief portion defined by an edge 60 that extends longitudinally along the side surfaces 54 and is configured to receive and mate with an edge of the backstrap. The edge 60 (and the corresponding mating edge of the backstrap) may be arcuate such that upon attaching the backstrap to the side surfaces 54, the fixed grip portion 50 provides a comfortable surface around which a user's hand may be positioned.

The rear surface 56 is substantially perpendicularly oriented relative to the side surfaces 54 and is formed (e.g., in a molding, casting, or machining process) to have two standoff elements 62, each standoff element including a bore 64. Although the fixed grip portion 50 is illustrated as having two standoff elements 62, it should be understood that any number of standoff elements 62 may be positioned on the rear surface 56. In embodiments in which more than one standoff element 62 is incorporated into the structure of the rear surface 56, the standoff elements 62 are preferably aligned such that the bores 64 thereof are in register. The bores 64 are dimensioned to receive a locking element typically a locking pin, that extends from the removable grip portion and is positioned through the bores 64 to facilitate the retention of the removable grip portion on the fixed grip portion 50.

Figure 4:
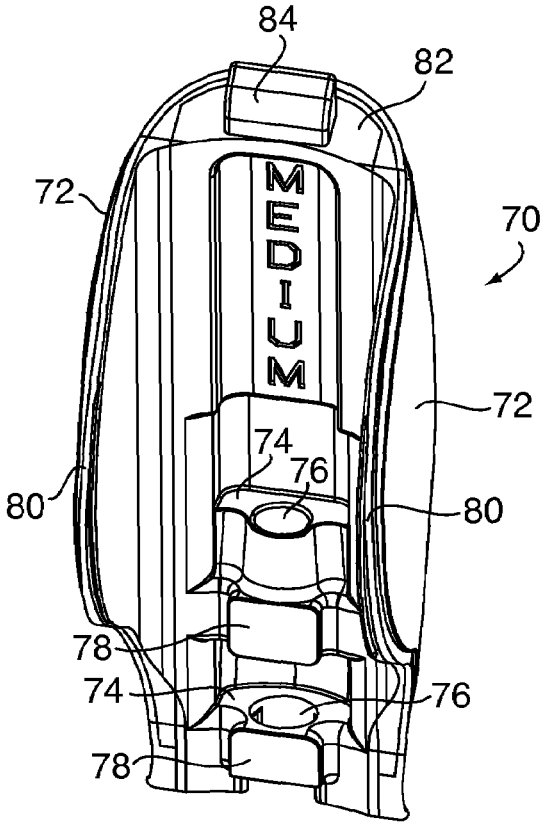
FIG. 4 is a perspective view of the backstrap.

Referring now to FIG. 4, a backstrap 70 is shown as a removable grip portion that is positionable on the fixed grip portion of the handgun comprises an outer grip portion, shown as a shell-like structure having opposing side surfaces 72. An inner surface of the shell-like structure has standoff elements 74 formed (e.g., molded, cast, or machined) therein and positioned to interengage with the standoff elements formed on the fixed grip portion. The standoff elements 74 have bores 76 that are aligned and register with the bores on the fixed grip portion. In one embodiment, the standoff elements 74 include flat surfaces 78 that engage corresponding surfaces on the rear surface of the fixed grip portion of the frame. The side surfaces 72 of the backstrap 70 each terminate in an edge 80 that is dimensioned and configured to be received against the corresponding edge surfaces on the side surfaces of the fixed grip portion.

A top edge 82 of the backstrap 70 includes a tab 84 or similar protrusion that protrudes from the edge surface. The tab 84 is configured to be received in a corresponding aperture (shown at 94 with reference to FIG. 6 below) at the top edge of the relief portion on the fixed grip portion. The tab 84 may be dimensioned to be received in the aperture 94 in a friction fit, or it may snappingly engage the aperture 94.

Preferably, the backstrap 70 is fabricated from a material that provides comfort to the user when the handgun is grasped. Materials from which the backstrap 70 may be fabricated include, but are not limited to, thermoplastics, thermosets, wood, ivory (synthetic or natural), bone, and the like. If the backstrap 70 is manufactured from a plastic material, the plastic is preferably injection molded to the desired shape. Furthermore, if the backstrap is plastic, an elastomeric material may be overmolded thereto to provide even greater comfort to the user. In any embodiment, the appearance surfaces of the backstrap 70 may be knurled, checkered, or otherwise textured to provide a finish that enhances the user's grip on the handgun.

It will be appreciated that the various embodiments described, utilizing fixed and removable grip portions, locking elements, and associated structure provide an advantageous means for configuring the grip of a handgun for various shooting applications. As also discussed below, those skilled in the art will also appreciate that the present invention is not limited to the described embodiments and means, but that various changes may be made and equivalents may be substituted for elements thereof without departing from the scope of the invention.

Figure 5:
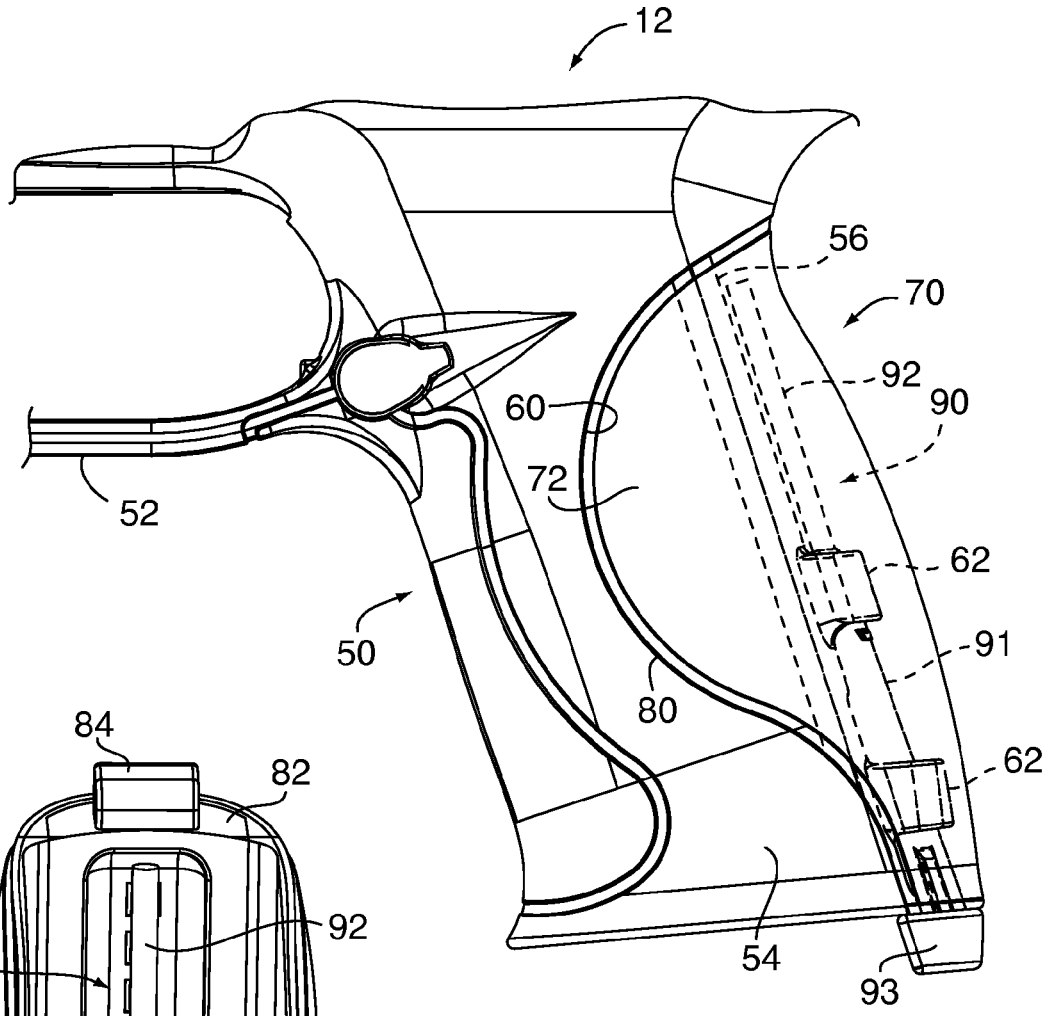
FIG. 5 is a cutaway side view of a pistol having the removable backstrap mounted thereto.
Figure 7:
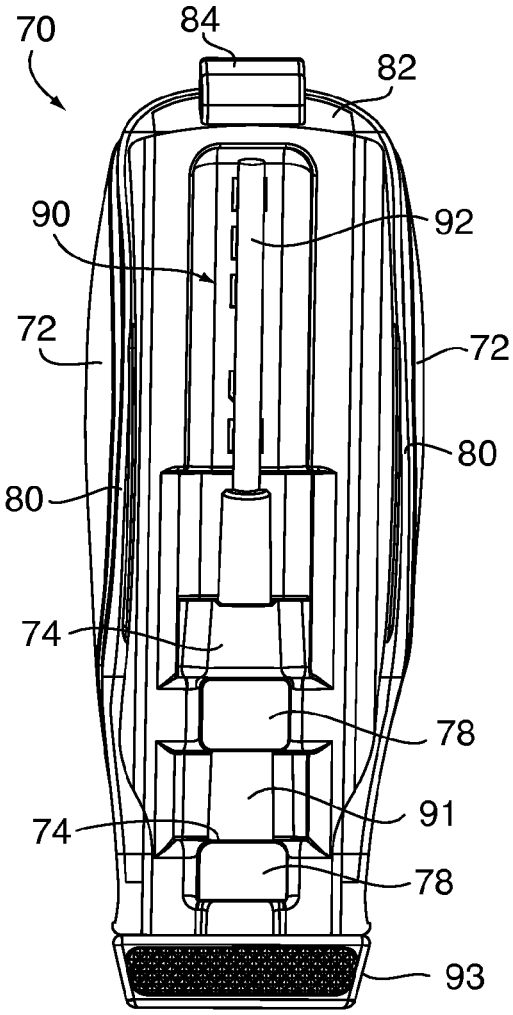
FIG. 7 is a perspective view of the backstrap having the locking pin positioned thereon.
Figure 6:
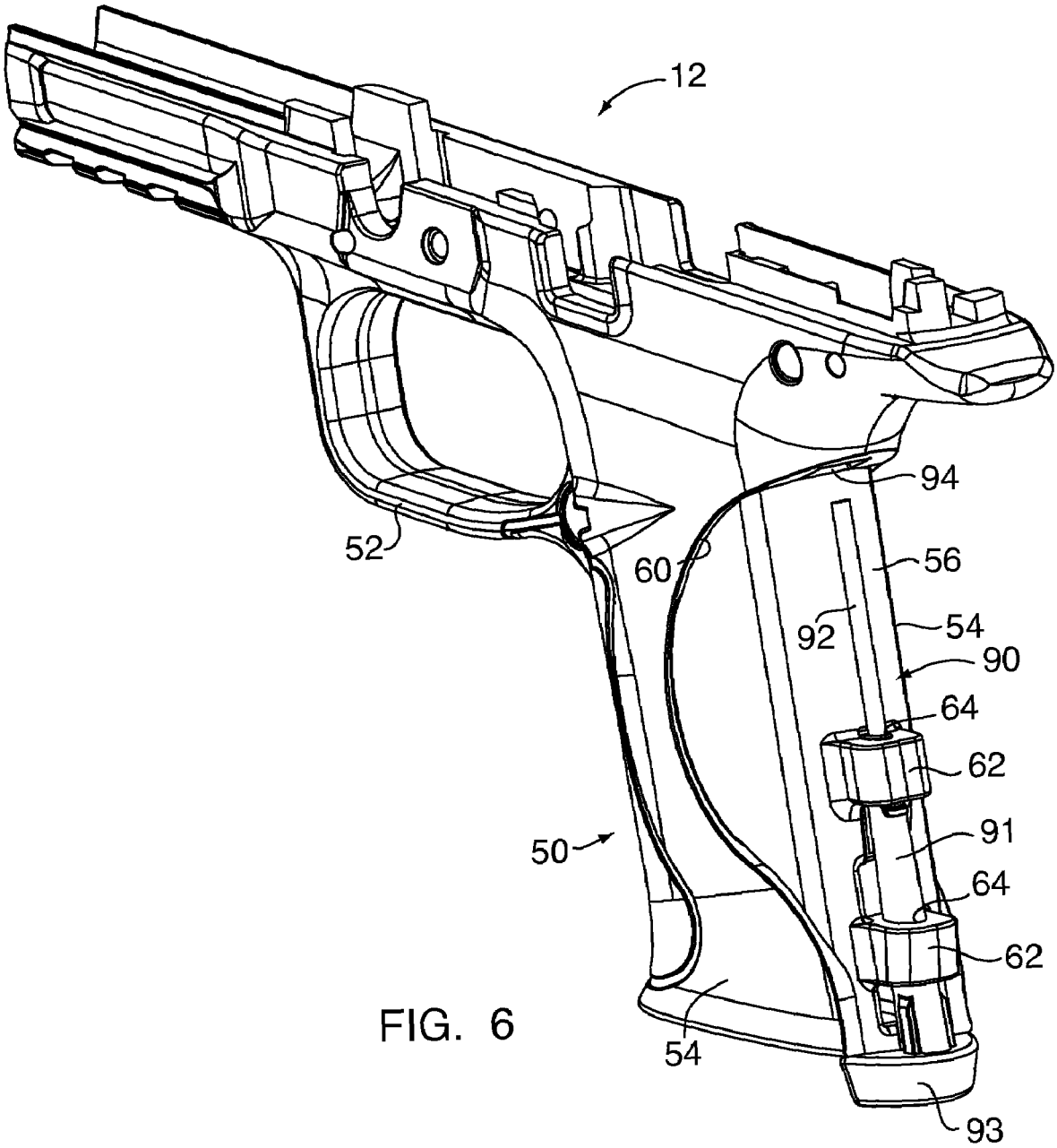
FIG. 6 is a perspective view of a frame of the pistol having a locking pin for mounting the removable backstrap positioned thereon.

Referring now to FIGS. 5-7, the backstrap 70 is mounted to the fixed grip portion 50 via a locking element, or pin, 90 that is inserted from the bottom of the backstrap 70 and through the apertures in the standoff elements 74 of the backstrap 70 and through the apertures in the standoff elements 62 of the fixed grip portion 50. The standoff elements 62, 74 with their associated apertures, in conjunction with the locking pin 90, operate in the same manner as a simple door hinge. The locking pin 90 may be positively engaged in any one of a variety of manners including, but not limited to, a simple pressure fit, a bayonet-type engagement, a camlock engagement, or the like. In a camlock engagement, for example, an axial rotation of the locking pin 90 preferably causes the engagement of mating surfaces that retain the backstrap 70 on the grip portion 50.

In operation, referring to FIGS. 5-7, to attach the backstrap 70 to the grip 50, the backstrap 70 is first aligned to face the grip portion 50. The tab 84 is angled to align with the aperture 94, and is then inserted therein. At the same time, the backstrap 70 is rotated downwards to come into contact with the grip 50. This brings the standoff elements 74 into staggered alignment with the grip standoff elements 62. Preferably, there is a close tolerance between the standoff elements 62, 74 such that the backstrap 70, in effect, removably snaps together with the grip 50. Then, the locking pin 90 is aligned with the aperture of the bottom standoff element 74 of the backstrap 70 and is inserted through the aperture in the bottom standoff element 62 of the frame 12. When urged, aided by a handling portion 93, into the fixed grip portion 50 in the direction of the slide, an insertion portion 91 the locking pin 90 then is disposed through the upper standoff element 74 of the backstrap 70 and subsequently through the upper standoff element 62 of the frame 12. Once fully inserted, an upper extending portion 92 of the locking pin 90 is housed in a recess formed between an inner surface of the upper portion of the backstrap 70 and an upper portion of the rearward surface of the frame 12. The upper portion, or extension, 92 of the locking pin 90, in addition to helping with securing the backstrap 70 to the frame 12, also functions as a tool for general maintenance use on the handgun 10. The locking pin 90 is then locked into position as above to prevent the inadvertent removal of the backstrap 70 from the frame 12.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A configurable firearm grip comprising:

a fixed grip portion having a first standoff element extending outwardly therefrom, said first standoff element having a first bore therein;

a removable grip portion having a second standoff element extending outwardly therefrom, said second standoff element having a second bore therein; and a locking element removably disposed through said first and second bores, configured to secure said removable grip portion to said fixed grip portion;

wherein each of said first and second standoff elements includes a bore-containing surface, such that said bore-containing surfaces abut when said removable grip portion is connected to said fixed grip portion;

wherein said fixed grip portion includes an aperture and the removable grip portion includes a protrusion accommodated by said aperture, said first and second standoff elements being connected to said fixed and removable grip faces, respectively, such that rotation toward said fixed grip portion of said removable grip portion about an axis formed by said protrusion brings said bore-containing surfaces into abutment when said locking element is removed.

2. The configurable firearm grip of claim 1, wherein an enclosed recess is at least partially defined between said fixed grip portion and said removable grip portion when said removable grip portion is secured to said fixed grip portion.

3. The configurable firearm grip of claim 2, wherein said locking element includes a locking element extension suitable for general firearm maintenance, said locking element extension being accommodated within said enclosed recess when said locking element is disposed through said first and second bores.

4. The configurable firearm grip of claim 1, wherein said second standoff element includes a flat surface arranged such that said flat surface engages a corresponding surface on said fixed grip portion when said removable grip portion is connected to said fixed grip portion.

5. The configurable firearm grip of claim 1, wherein said locking element is securely disposed within said first and second bores by a pressure fit arrangement.

6. The configurable firearm grip of claim 1, wherein said locking element is securely disposed within said first and second bores by a camlock engagement.

7. The configurable firearm grip of claim 1, wherein said locking element is securely disposed within said first and second bores by a bayonet engagement.

8. The configurable firearm grip of claim 1, wherein said fixed grip portion includes a relief surface defined by a relief surface edge, and said removable grip portion includes a complementary edge, said complementary edge designed to mate with said relief surface edge when said removable grip portion is secured to said fixed grip portion.

9. The configurable firearm grip of claim 1, wherein said relief surface edge and said complementary edge are arcuate.

* * * * *